United States Patent [19]

Morgan

[11] Patent Number: 4,834,594

[45] Date of Patent: May 30, 1989

[54] DRILL STEEL DRIVE UNIT

[75] Inventor: Richard E. Morgan, Morgantown, W. Va.

[73] Assignee: Fansteel Inc., North Chicago, Ill.

[21] Appl. No.: 34,048

[22] Filed: Apr. 6, 1987

[51] Int. Cl.[4] ..... B23B 45/14; E21C 9/00

[52] U.S. Cl. ..... 408/239 A; 81/124.4; 175/320; 279/14

[58] Field of Search ..... 408/226, 712, 239, 239 A, 408/130; 81/124.4, 124.5; 173/34, 36; 175/300, 320; 279/14

[56] References Cited

U.S. PATENT DOCUMENTS

| | | | |
|---|---|---|---|
| 2,878,701 | 3/1959 | Weersma | 81/124.4 X |
| 4,226,290 | 10/1980 | McSweeney | 175/320 |
| 4,339,006 | 7/1982 | Bower, Jr. et al. | 175/320 X |
| 4,558,976 | 12/1985 | Begluitti | 408/226 |

*Primary Examiner*—Z. R. Bilinsky

*Attorney, Agent, or Firm*—Barnes, Kisselle, Raisch, Choate, Whittemore & Hulbert

[57] ABSTRACT

A chuck to be power driven for rotating drill bits in the mining and construction fields. The chuck is designed to drive one or more telescoped drill steels which carry a mining bit and is designed to drive drill steels with square drive ends, large hexagonal drive ends, small hexagonal drive ends and large and small hexagonal ends as well as roof bolt units without modification.

1 Claim, 2 Drawing Sheets

DRILL STEEL DRIVE UNIT

FIELD OF INVENTION

Power drilling in the mining and construction fields for roof drilling, tunneling, rock drilling and so on with rotary or percussion drive.

BACKGROUND AND OBJECTS OF THE INVENTION

The present invention is directed to the utilization of earth or rock or mineral drilling bits which are power driven in rotation. In many applications, deep holes are drilled in circumstances where there is not enough clearance in the working area to accommodate the use of a long drill shank. In addition, replaceable bits are used. Under these circumstances, it has been common to provide a series of drill steels which can be joined together as the depth of the hole increases. These drill steels may consist of a starter driver bar having a lower end to connect to the motor or power drive and an upper end to receive a bit. This assembly is used to drill to a certain depth. Then the starter bar is removed and a lead extension is connected to the driver and the bit. Subsequently, a middle extension is used and extensions are used until the hole has reached the desired depth. The composite extensions are called a drill string.

U.S. Pat. No. 4,009,760 to Hansen and Smarrella issued Mar. 1, 1977 has a disclosure pertinent to this art. The U.S. Pat. No. 3,519,091 to Leibee and Oaks, issued July 7, 1970, is also pertinent to the general field of drilling.

Some of the drilling in underground areas is called roof drilling wherein holes are drilled in the roof of the cavity and roof bolts are driven or installed into these holes to reinforce the upper area of the cavity to prevent collapse.

There are number of different starter drill steels and also a number of different manufacturers of power units which drive the steels in the course of the drilling. These power units have different external socket shapes ranging from axially narrow gear teeth to long gear teeth, axially extending splines and axial grooves, and wide spaced splines. Each will fit a power driver of a particular manufacturer.

In addition, there are a number of different shapes for drill steels including those with a square or hexagonal driver with round or hexagonal intermediate portions at different axial locations.

It is an object of the present invention to provide a drive chuck which can have an external shape to fit respective power drives of different manufacturers and also have an internal shape to fit a variety of different ends on bit carrying steels as well as roof bolt nuts. The use of a drive chuck of this nature reduces the inventory needed at a mine site and allows the use of drill steels of a variety of manufacturers.

Other objects and features of the invention will be apparent in the following description and claims in which the principles of the invention are set forth together with details to enable persons skilled in the art to practice the invention, all in connection with the best mode presently contemplated for the invention.

BRIEF DESCRIPTION OF THE DRAWINGS

DRAWINGS accompany the disclosure and the various views thereof may be briefly described as.

DETAILED DESCRIPTION OF THE PRINCIPLES OF THE INVENTION TOGETHER WITH DETAILS TO ENABLE THOSE SKILLED IN THE ART TO PRACTICE THE INVENTION

Figure 7:
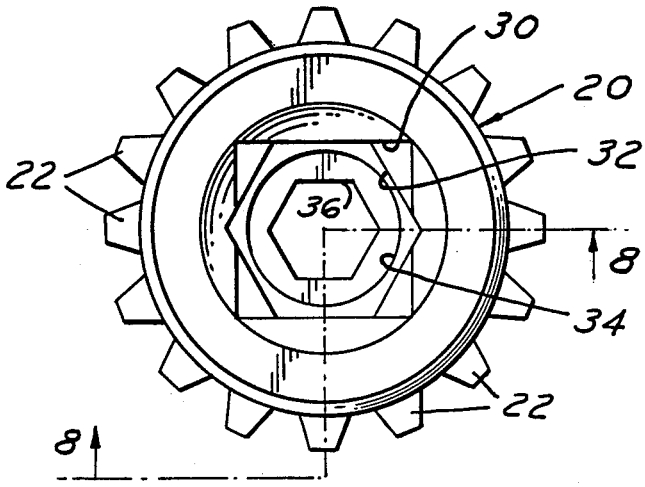
FIG. 7, an end view of a drive chuck
Figure 9:
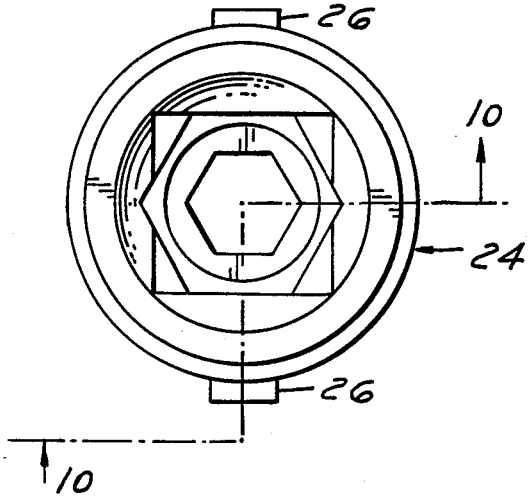
FIG. 9, an end view of a modified drive chuck.
Figure 10:
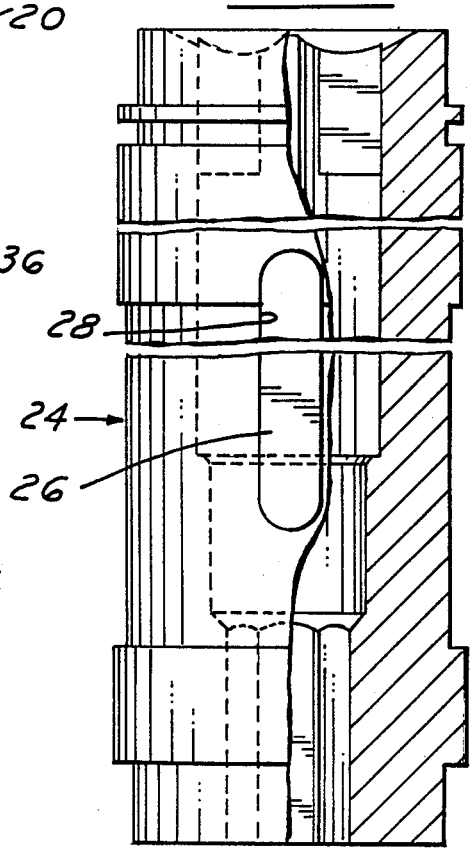
FIG. 10, an elevational view partially in section of a drive chuck taken on line 10—10 of FIG. 9.

With reference, first, to FIGS. 7 to 10, in FIGS. 7 and 9 are respective end views of to chuck shown each with a different drive. In FIG. 7, the chuck 20 is shown with an external drive as a series of gear teeth 22 spaced around the outer surface. In FIG. 9, a chuck 24 has opposed drive splines 26 seated in slots 28. These chucks are typical of drivers made by different manufacturers which produce different power-driven units for rotating the chucks.

The interior of the chucks are, however, the same and each is designed to drive drill steels which have different drive ends to be received in the chucks. Each chuck has a short square recess 30 adjacent the mouth of the chuck. The socket 30 at the mouth of the chuck has a configuration which will receive a square drive shank or a hexagonal drive shank as will be seen in the end view of the chuck in FIGS. 7 and 9. Below this square recess is an hexagonal recess 32 which may be characterized as the large hexagonal recess. Below this large hexagonal recess is a round recess 34 and below the round recess 34 is a smaller hexagonal recess 36.

Figure 1:
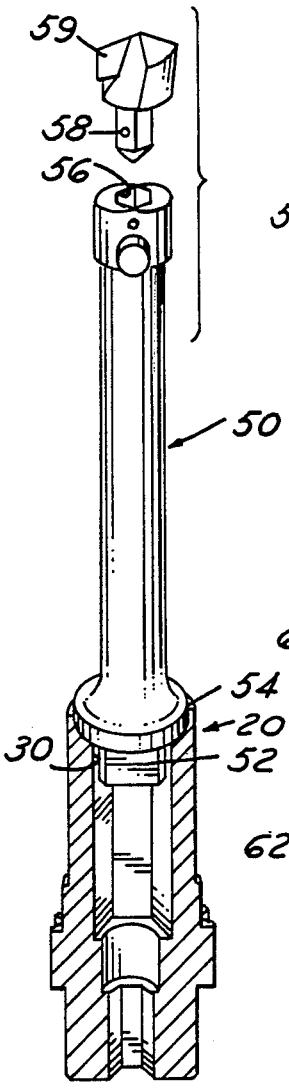
FIG. 1, a view of a power chuck interfitted with a square drive drill steel.

In FIGS. 1 to 6, various drill steels are illustrated installed in a chuck 20. In FIG. 1, a round drill steel 50 has a square drive end 52 which inserts into the square recess 30. A circular flange 54 limits the entrance of the drive end and provides a thrust shoulder. The distal end of the steel has a socket 56 to receive a square drive shank 58 of a drill bit 59.

Figure 2:
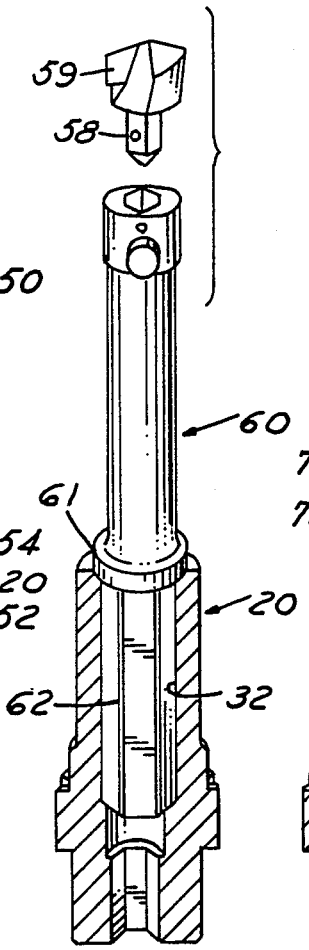
FIG. 2, a view of a power chuck interfitted with a long hex drive drill steel.

In FIG. 2, a round drill steel 60 has a circular collar 61 to provide a thrust shoulder below which is a long hexagonal drive shaft 62 received in the large hexagonal recess 32 of the chuck 20. Here also the distal end of the steel 60 has a drive recess to engage the drive shank 58 of bit 59.

Figure 3:
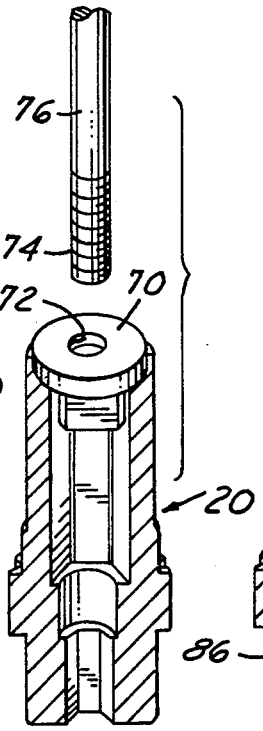
FIG. 3, a view of a power chuck interfitted with a roof bolt nut having a square drive portion.

In FIG. 3, a roof bolt nut 70 has a square shank to socket into the end of chuck 20 and a center threaded bore engages the threaded end 74 of a roof bolt 76.

Figure 4:
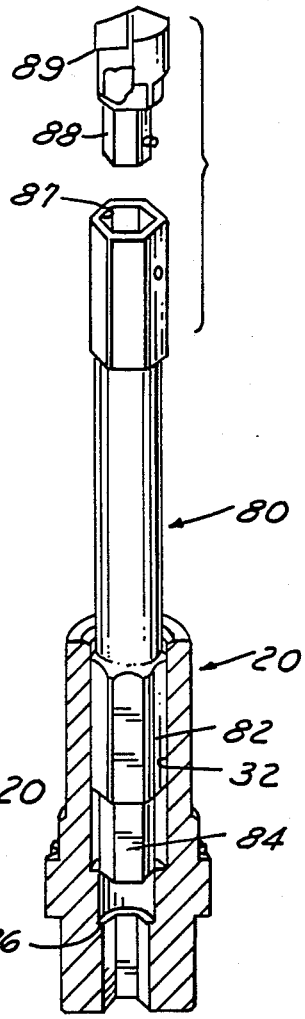
FIG. 4, a view of a power chuck interfitted with a double hex end on a drill steel.

In FIG. 4, a hexagonal drill steel 80 has a two-step hexagonal drive shank 82, 84 which is received in the large hexagonal recess 32. The corners of the small hexagonal portion 84 seat on a shoulder 86 at the top of the round section 34. A hexagonal recess 87 at the distal end of steel 80 receives an hexagonal shank 88 of a bit 89.

Figure 5:
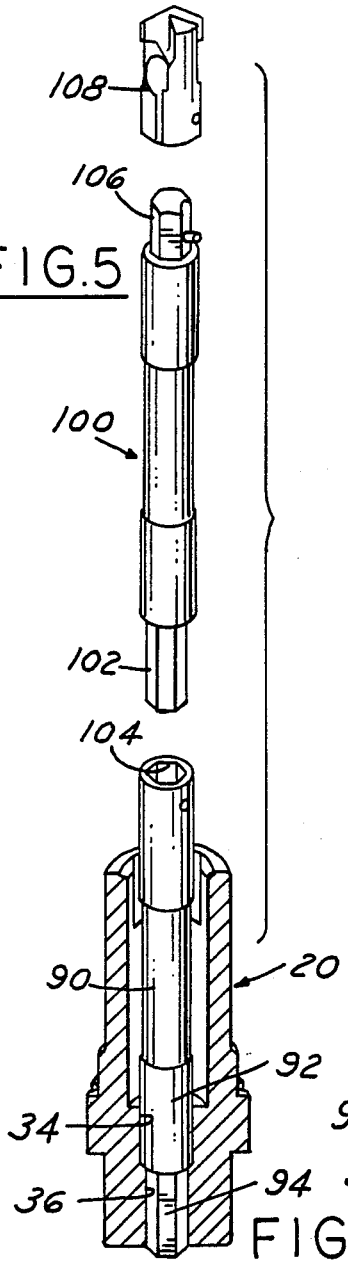
FIG. 5, a view of a power chuck interfitted with a round drill steel with a short hex drive at the proximal end and an extension steel and bit.
Figure 6:
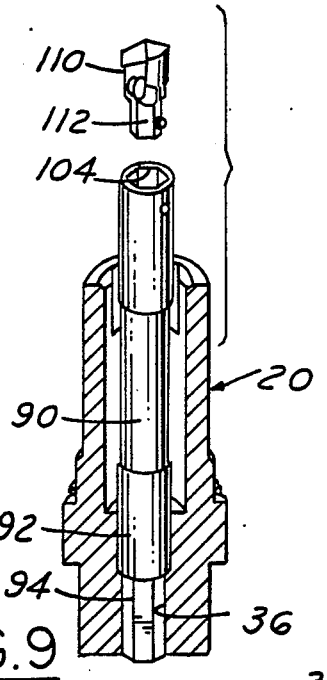
FIG. 6, a view similar to FIG. 5 with a bit having a male hex drive end.
Figure 8:
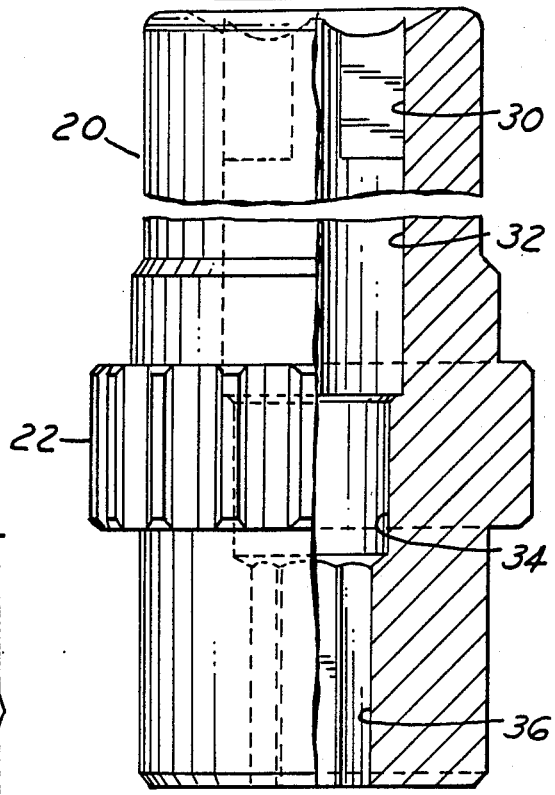
FIG. 8, an elevational view of a drive chuck partially in section on line 8—8 of FIG. 7.

In FIG. 5, the chuck 20 is shown in combination with an inserted round drill steel 90 having a portion 92 interfitting with the round section 34 of the chuck recess and a smaller hexagonal drive shank 94 socketed in the small hexagonal section 36 of the chuck. FIG. 5 also illustrates a second and similar drill steel 100 with a drive shank 102 to insert in an hexagonal socket 104 in drill steel 90. This drill steel 100 can have a hexagonal distal drive section 106 to insert into the female recess of a drill bit 108 having an internal drive recess. If a bit like that shown in FIG. 4 at 89 were to be used, the distal end of steel 100 would be provided with an hexagonal socket 104 as shown in the drill steel 90 in FIG. 5. This is illustrated in FIG. 6 where the bit 110 has a hexagonal shank 112 to insert into recess 104.

It will thus be seen from the above that a variety of drill steels can be accommodated by the chuck 20 or the chuck 24 which have the stepped and varied recesses 30, 32, 34, and 36. The recesses graduate from the bore 30 at the mouth of the chuck which will accept square or large hexagonal drive shanks, and then to a longer hexagonal recess graduating at a shoulder to a round recess and then at a second shoulder to a smaller hexagonal recess.

What is claimed is:

1. A power drive chuck for driving drill steels and the like for roof drilling in the mining industry and for drilling in the mining and construction industry which comprises:

(a) an elongate drive chuck for drill steels and mining bits configured to be power driven by a prime mover, and (b) a central passage formed in said drive chuck having an open end to receive a drive shank of a drill steel, said passage being formed at said open end with a flat annular shoulder with a first axial recess having a cross-section to receive and drive square shanks on a drill steel, a first drill steel selectively insertable in said central passage having a square shank with an annular shoulder extending outwardly to rest on said flat annular shoulder of said drive chuck, a second coaxial recess below said first recess having a first hexagonal cross-section to drive drill steels with an elongate hexagonal drive shank, a second drill steel selectively insertable in said central passage having a hexagonal drive shank with an annular shoulder extending outwardly to rest on said flat annular shoulder of said drive chuck, (c) a third recess formed coaxially with and below said first and second recesses to receive and drive a drill steel having a second and smaller hexagonal drive shank, said bore having also a fourth circular recess between said second and third recesses having diameter less than the included diameter of said second hexagonal recess to form a second annular shoulder at the base of said second coaxial recess to provide axial support for said second drill steel and to provide a third annular shoulder below said second annular shoulder and above said third recess, and a third drill steel selectively insertable in said central passage having a second hexagonal drive shank and a circular cylindrical section above said second hexagonal drive shank forming an annular shoulder to rest on said third annular shoulder above said third recess to provide axial support for said third drill steel.

* * * * *